United States Patent [19]

Ouellette

[11] Patent Number: 4,770,223

[45] Date of Patent: Sep. 13, 1988

[54] BIDIRECTIONAL AWNING ROLLER

[75] Inventor: Alfred R. Ouellette, Saugus, Mass.

[73] Assignee: Faulkner Manufacturing Company, Malden, Mass.

[21] Appl. No.: 934,677

[22] Filed: Nov. 25, 1986

[51] Int. Cl.[4] ..... E06B 9/208

[52] U.S. Cl. ..... 160/302; 160/305; 160/67

[58] Field of Search ..... 160/302, 300, 301, 303, 160/305, 22, 66, 67, 69, 70; 135/89; 188/82.2, 82.3, 82.34, 82.84

[56] References Cited

U.S. PATENT DOCUMENTS

| | | | |
|---|---|---|---|
| 882,082 | 3/1908 | Schroyer | 160/303 X |
| 1,050,703 | 1/1913 | Siever | 188/82.34 |
| 2,019,085 | 10/1935 | Miller | 160/303 X |
| 3,870,096 | 3/1975 | Horrell | 160/305 |
| 4,112,996 | 9/1978 | Föhl | 160/302 X |
| 4,524,791 | 6/1985 | Greer | 135/89 |
| 4,607,654 | 8/1986 | Duda | 160/300 X |

*Primary Examiner*—Ramon S. Britts
*Assistant Examiner*—David M. Purol
*Attorney, Agent, or Firm*—Weingarten, Schurgin, Gagnebin & Hayes

[57] ABSTRACT

An awning roller with a two-position, bi-directional locking mechanism. In the first position, rotation of the roller is permitted in a clockwise direction, but prevented in a counterclockwise direction. The second position allows rotation in a counterclockwise direction, but not in a clockwise direction. The roller comprises an outwardly facing pinion gear at one end of the roller. A pawl is rotatably mounted adjacent the pinion gear to interact with the teeth so as to control the direction of rotation of the roller as described above. The pawl can be repositioned relative to the ratchet disc to change the locking mechanism from its first position to its second position and back again.

9 Claims, 4 Drawing Sheets

BIDIRECTIONAL AWNING ROLLER

FIELD OF THE INVENTION

An awning roller having a two-position, bi-directional locking mechanism.

FIELD AND BACKGROUND OF THE INVENTION

Awning deployment devices such as those that can be attached to store fronts, trailers, mobile homes, etc. have used a variety of mechanical configurations to store, position, and support awning canopies. They include various devices to unroll the awning canopy from a roller bar as well as mechanical means of locking the canopy in position so that it is secured is its unfurled state. U.S. Pat. No. 3,870,096 discloses such a device which includes an eccentric brake inside an awning roller to brake the rotational movement of the roller. U.S. Pat. No. 4,524,791 similarly shows a roller with an internal brake member, the brake member being in engagement with an eccentric also positioned inside the roller. The brake systems in these references, however, have at least two drawbacks. The first is that the mechanisms are wholly internal to the roller. Maintenance, as well as repair, is made difficult because the assembly must be disassembled in order to get to the braking mechanism. Second, since the braking action relies upon friction, the brakes may slip or fail to hold under certain load condition. Other prior art devices brake against the shaft rather than a drum, as in U.S. Pat. No. 3,021,090, where an eccentric brake cooperates with a shaft to provide a uni-directional braking system. Once again, however, this mechanism is disposed inside the awning roller and as before utilizes friction to engage the shaft, thus permitting slippage to occur. A third drawback to the shaft braking device is that the mechanism is uni-directional and cannot be repositioned to change the direction of motion against which the brake is operable.

SUMMARY OF THE INVENTION

An awning roller with a two-position, bi-directional locking mechanism, the latter operatively engaged to control movement of the roller around its longitudinal axis. The locking mechanism, in a first position, allows rotation of the roller in a clockwise direction, but not in a counterclockwise direction. In a second position, the roller is permitted to rotate in a counterclockwise direction, but not in a clockwise direction. The roller is capable of rotation around its central longitudinal axis and includes an outwardly facing pinion gear at one end. The locking mechanism comprises a pawl which is in mechanical engagement with the pinion gear so as to prevent or permit rotation of the roller in a given direction. The pawl is biased towards the pinion gear by a spring so that when the roller is moved in the direction in which motion is permitted and the pawl is moved outwardly from the pinion gear by the teeth, the pawl is forced back toward the pinion gear to remain in constant engagement with the teeth thereof.

The locking mechanism and the pinion gear are located on the outside of the roller. Thus, repair and maintenance of the apparatus is made easier and more accessible. There is also little chance of slippage by the roller because the pawl is reliably engaged with the teeth of the pinion gear rather than depending upon frictional forces which can lead to slippage.

BRIEF DESCRIPTION OF THE DRAWINGS

These and other features of the present invention are more fully illustrated in the solely exemplary detailed description and accompanying drawings of which.

DETAILED DESCRIPTION OF THE INVENTION

Figure 1:
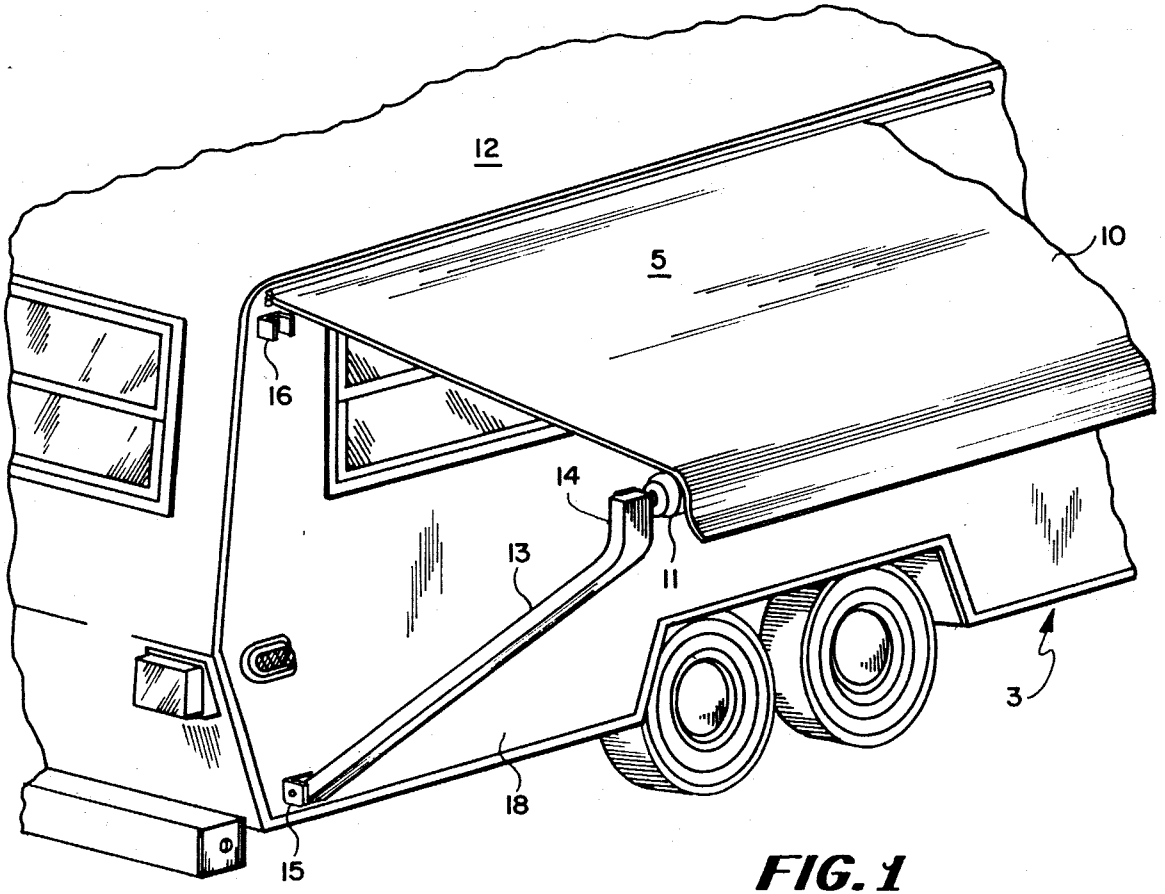
FIG. 1 illustrates an unfurled awning mounted to a mobile home.

The present invention can be utilized by an awning 10, as shown in FIG. 1, which has been unfurled from mobile home 12. Awning 10 which is attached to mobile home 12 by bracket 16 which is mounted upon a side 18 of mobile home 12. Awning 10 also includes roller 20, as depicted in FIG. 2, which is supported on either side by arms 13, arms 13 being mounted to mobile home 12 by brackets 15 which are also affixed to side 18 of mobile home 12.

Figure 2:
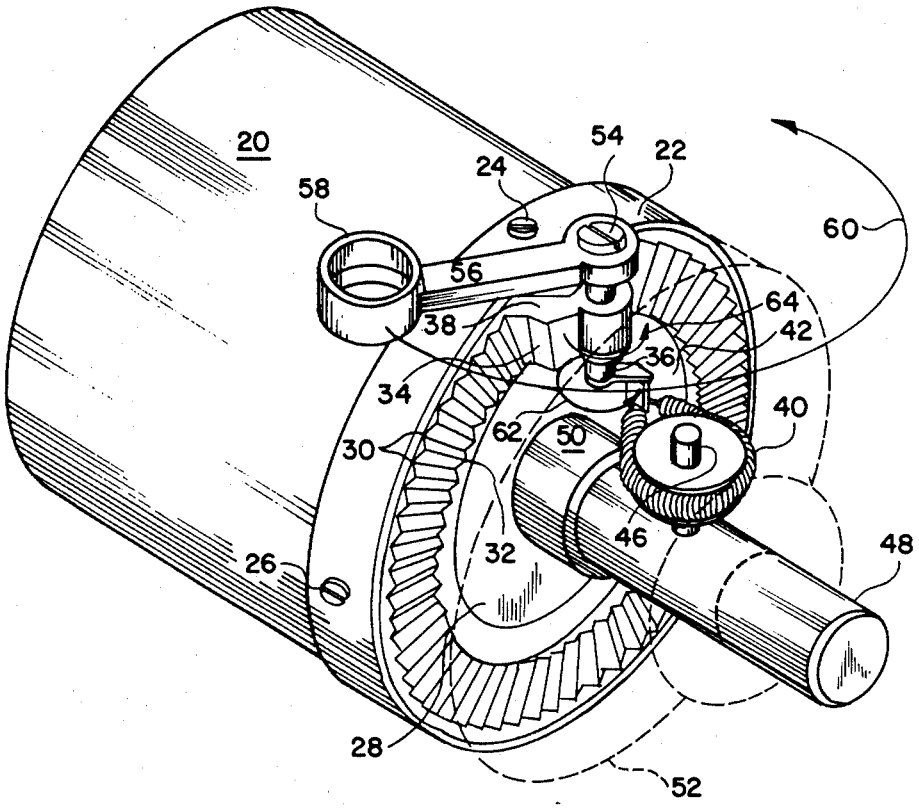
FIG. 2 is a cutaway pictorial view of the locking mechanism for the preferred embodiment of the present invention.

FIG. 2 illustrates the locking mechanism and shows awning roller 20 having end section 22 attached thereto by screws 24 and 26. End section 22 has a pinion gear 28 which comprises a series of teeth 30 and an end sleeve 50. The teeth 30 are positioned to face outwardly and away from the end of the rooler. A central shaft 48 extends through and end sleeve 50. A pawl 34, which is capable of fitting in between teeth 30 of pinion gear 28, is mounted to a pawl shaft 36. Pawl shaft 36 includes spring arm 38 to which spring 40 is affixed at hook 42. Spring 40 is wrapped around a mounting wheel 44 which is attached to a mounting shaft 46. The spring assembly is then mounted to central shaft 48 via mounting shaft 46. Spring 40 is used to bias pawl 34 toward pinion gear 28 so that the two remain in engagement.

A positioning arm 56 with a circular grip 58 at its terminal end is affixed to pawl shaft 36 by screw 54 and the positioning arm 56 extends away from the axis of and is perpendicular to pawl shaft 36. The positioning arm 56 is used to rotate pawl 34 so as to move the locking mechanism from its first position to its second position and vice versa and is thus used to control whether rotational motion is permitted in a clockwise or a counterclockwise direction. A hood 52, shown by dashed lines, fits over the locking mechanism except for positioning arm 56 and a short extension of pawl 36.

Figure 3:
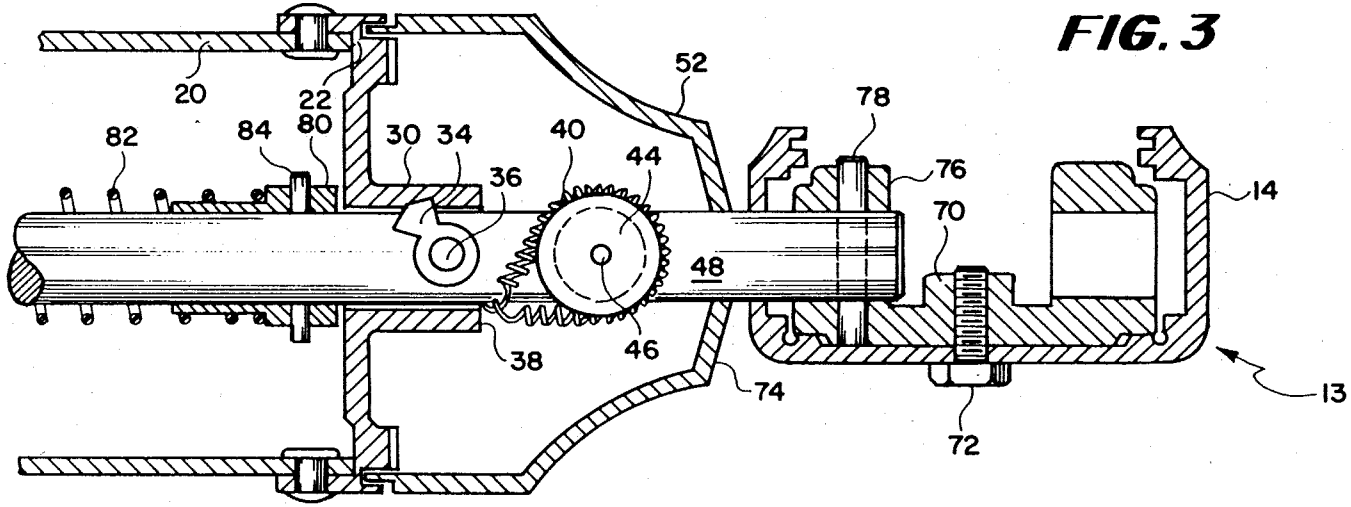
FIG. 3 is a longitudinal cross section of the embodiment of FIG. 2.

FIG. 3 is a different visual perspective of the locking mechanism showing many of the elements shown in FIG. 2. FIG. 3 also shows arm 13 and a U-shaped mounting bracket 70 which is secured to arm 13. The central shaft 48 is secured to bracket 70 by a first pin 78. An inner sleeve 80 is disposed around central shaft 48 and is affixed thereto by a second pin 84. Spring 82 is wrapped around central shaft 48 in the form of a cylindrical flight and is secured to inner sleeve 80. The spring 82 is also secured to a second end section (not shown) located at the opposing end (not shown) of roller 20 such that the spring can be placed into tension by rotation of the roller. It will be appreciated that the distance between the second pin 84 and the point at which spring 82 is secured to the second end section is sufficient to permit rotation of the roller 20 to impart tension into spring 82.

Figure 4:
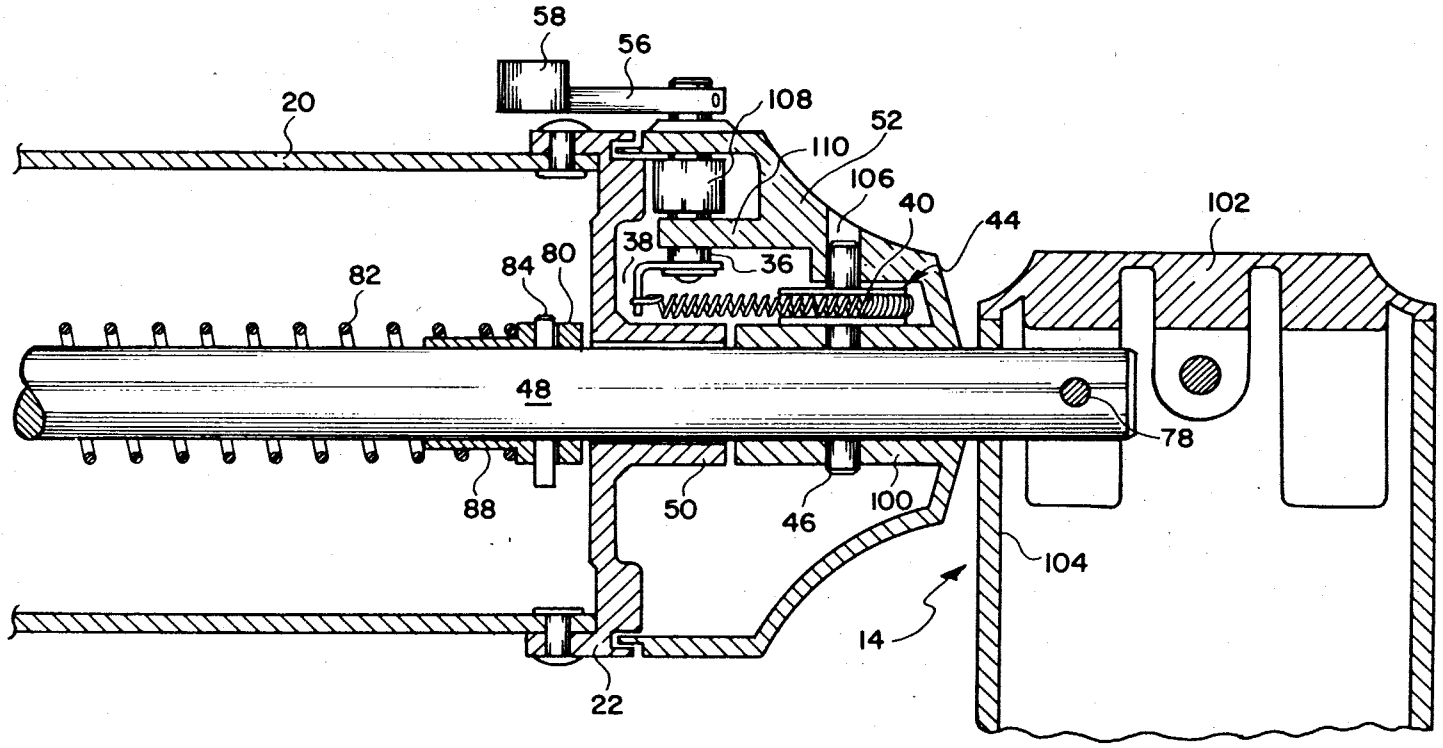
FIG. 4 is a longitudinal cross section of the embodiment of FIG. 2 and rotated 90 degrees from the cross-section view of FIG. 3.

FIG. 4 illustrate the embodiment of FIG. 3 after rotation of the embodiment through 90 degrees. FIG. 4 shows greater detail of hood 52. Mounting shaft 46 extends into slot 106 of hood 52 penetrates and central shaft 48. Pawl shaft 36 is supported by upper flange 108 and lower flange 110 of hood 52.

Figure 5A:
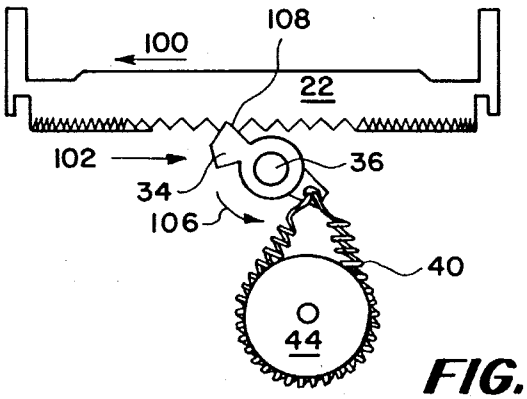
FIGS. 5A and 5B are diagrammatic views which illustrate the mechanical operation of the locking mechanism of the embodiment of FIG. 2.
Figure 5B:
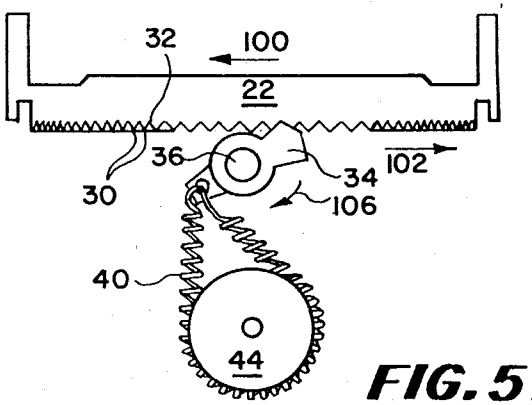

FIGS. 5A and 5B show the bi-directional operation of the present invention. In each figure, pawl 34 is positioned between adjacent gear teeth 30. FIG. 5A permits movement of end section 22 in the direction of arrow 100 by allowing tooth 108 to push against pawl 34 so that pawl 34 rides over tooth 108 and pivots the pawl in the direction of arrow 104. This movement also pulls spring 40 away from mounting wheel 44 and thus placing spring 40 into tension such that once tooth 108 has passed pawl 34, spring 40 biases pawl 34 back towards end section 22 again positioning pawl 34 between adjacent gear teeth. Movement of end section 22 in the direction of arrow 102, however, pushes the pawl against pawl shaft 36 preventing rotation of the roller in that direction. The positioning of pawl 34 in FIG. 2 permits movement of roller 20 is a counterclockwise direction as is shown in FIG. 5A. Since the locking mechanism is bi-directional, it can be reversed by rotating arm 56 in a counterclockwise direction as shown by arrow 60 in FIG. 2 which in turn rotates pawl 34 in the same direction, shown by arrow 64, and rotates spring arm 38, as shown by arrow 62. Once pawl 34 has been rotated to the other side of pawl shaft 36, it is positioned adjacent to end section 22 as shown in FIG. 5B. In FIG. 5B, movement in the direction of arrow 102 is permitted, as described before, but motion in the direction of arrow 100 is prevented.

The detailed description is intended to be solely exemplary and it is intended that the invention only be limited by the claims included herewith.

What is claimed is:

1. A locking mechanism for an awning roller, comprising:

stationary central shaft means defining a central axis thereof;

a cylindrical body having first and second ends said cylindrical body mounted for rotation about said stationary central shaft means in first and second rotational directions;

a gear secured at said first end having a plurality of teeth radially disposed about said central axis; and means for locking said gear against rotational movement comprising;

a pawl shaft;

a pawl mounted upon said pawl shaft; and means for positioning said pawl to lock said gear against rotational movement wherein said positioning means in a first position permits rotation of said cylindrical body about said central axis in said first rotational direction and prevents rotation in said second rotational direction, and wherein said positioning means in a second postion permits rotation about said central axis in said second rotational direction and prevents rotation in said first rotational direction, and further including:

a rotating arm connected to said pawl shaft to position said pawl in said first and second positions; and means for biasing said pawl into engagement with said plurality of teeth, and including:

a mounting wheel disposed on said stationary central shaft means adjacent said gear;

a spring arm connected to said pawl shaft; and a spring mounted upon said mounting wheel and connected to said spring arm.

2. The locking mechanism of claim 1 wherein said cylindrical body is hollow.

3. The locking mechanism of claim 1 wherein said stationary central shaft means comprises a shaft disposed coaxially to said central axis of said cylindrical body.

4. The locking mechanism of claim 1 wherein said gear is secured to said cylindrical body at least one screw.

5. The locking mechanism of claim 1 wherein said rotating arm further comprises a circular grip integrally formed at the end of said rotating arm distal said pawl shaft.

6. The locking mechanism of claim 1 wherein said shaft has a length greater than the length of said cylindrical body.

7. The locking mechanism of claim 3 further comprising a cover affixed to said shaft enclosing said gear and said pawl.

8. An awning roller locking mechanism comprising:

a hollow cylindrical body of substantially uniform diameter having first and second ends said cylindrical body mounted for rotation about a central axis in first and second rotational directions;

a stationary central shaft having a greater length than the length of said cylindrical body an disposed coaxially to said central axis;

a gear secured at said first end having a plurality of teeth radially disposed about the central axis;

a pawl shaft having first and second ends and mounted upon and extending perpendicularly from said central shaft adjacent said gear;

a pawl rotatably mounted upon said pawl shaft;

a spring arm extending from said first end of said pawl shaft;

a mounting wheel disposed on said central shaft adjacent said gear;

a spring connected to said spring arm and mounted peripherally upon said mounting wheel; and a positioning arm connected to said second end of said pawl shaft.

9. The awning roller locking mechanism of claim 8 further comprising a cover affixed to said center shaft enclosing said gear and said pawl.

* * * * *